US007021781B2

(12) United States Patent
Cohen et al.

(10) Patent No.: US 7,021,781 B2
(45) Date of Patent: Apr. 4, 2006

(54) METHOD AND PACKAGED PRODUCT, PARTICULARLY CHEMILUMINESCENT VESSEL, ENABLING CONTENTS TO BE DISTINGUISHED

(76) Inventors: Liran B. Cohen, 17 HaPrachim Street, RaAnana (IL) 43399; Alon Brand, Kfar Monash, Kfar Monash (IL) 42875

( * ) Notice: Subject to any disclaimer, the term of this patent is extended or adjusted under 35 U.S.C. 154(b) by 0 days.

(21) Appl. No.: 11/105,432

(22) Filed: Apr. 14, 2005

(65) Prior Publication Data

US 2005/0190548 A1 Sep. 1, 2005

Related U.S. Application Data

(63) Continuation of application No. 10/700,830, filed on Nov. 4, 2003.

(51) Int. Cl.
*F21K 2/00* (2006.01)

(52) U.S. Cl. ..... 362/34; 362/96; 362/101; 206/217; 206/220

(58) Field of Classification Search ..... 362/34, 362/101, 96; 206/217, 220
See application file for complete search history.

(56) References Cited

U.S. PATENT DOCUMENTS 5,370,222 A * 12/1994 Steigerwald et al. ..... 206/222
6,520,657 B1 * 2/2003 DeNicola ..... 362/34

* cited by examiner

*Primary Examiner*—Ali Alavi

(57) ABSTRACT

A chemiluminescent vessel is constructed from a double walled assembly which forms a sealed walled cavity containing a first chemiluminescent fluid. A compressible toroidal tube defines a sealed tube cavity containing a second chemiluminescent fluid. A frangible barrier separates the tube cavity from the wall cavity. A sidewall, attached to the double walled assembly and terminating in a neck that has a fluid opening, forms an inner container holding a beverage fluid. An inner cap forms a sealed closure with the neck of the inner container. An outer cap contains the inner cap and extends to shield the compressible toroidal tube from accidental compression. In one aspect, the first and second chemiluminescent fluids are selected to produce a specific color connoting a characteristic of the beverage contained in the inner container.

13 Claims, 5 Drawing Sheets

METHOD AND PACKAGED PRODUCT, PARTICULARLY CHEMILUMINESCENT VESSEL, ENABLING CONTENTS TO BE DISTINGUISHED

This is a continuation of U.S. patent application Ser. No. 10/700,830, filed on 4 Nov. 2003.

BACKGROUND OF THE INVENTION

The present invention relates generally to vessels and containers used in containing fluids. More particularly, this invention pertains to vessels used in consumer products which provide for novelty chemiluminescence by means of a two component reaction within sealed cavities of the vessel walls.

Alcohol is a favorite consumer beverage and is frequently served to the consumer in venues with reduced lighting, such as eating, drinking and dancing establishments. In such venues ambience is a critical feature. Proprietors of such establishments try to match the features of food and drink to the desired ambience favored by their clientele. More youthful and energetic consumers favor establishments providing containerized beverages. It has long been recognized that these consumers find beverages more attractive, and the activity involved in consuming such beverages more enjoyable, if the containers associated with such consumption are provided with a novel appearance.

Luminescence in vessels or containers for food or drink is known in the prior art. U.S. Pat. No. 5,171,081, issued to Pita, et al. on Dec. 15, 1992, discloses a double walled plastic beverage container having a chemiluminescent fluid disposed within the wall cavity. Another chemiluminescent fluid is contained separately within a compressible toroidal tube in the upper rim of the container. When the rim is flexed the toroidal tube is compressed, causing the fluid contained therein to rupture a thin membrane separating the fluids and thereby produce a chemiluminescent reaction.

In U.S. Pat. No. 6,474,467, issued to Kurdian on Nov. 5, 2002, a re-fillable plastic luminescing bottle is disclosed. The bottle incorporates an ampule having a frangible membrane separating the individual chemilumescent fluids.

The tube, or ampule, of the prior art is relatively unprotected from crushing and thus is subject to premature activation caused by accidental or intentional crushing. Finally, the chemiluminescent novelty of the prior art container cannot be readily associated with a branded packaged beverage because and activation of the chemiluminescent is not necessarily linked to consumption of any particular beverage.

From the perspective of the prepackaged beverage field, especially the prepackaged alcoholic beverage field, the prior art chemiluminescent containers are of limited value.

What is needed is a sealable chemiluminescent container for packaging beverages having a system by which opening the sealable closure of the beverage container simultaneously activates the chemiluminescent reactants.

What is also needed is a sealable chemiluminescent container for packaging beverages having a means of protecting the compressible tube commonly used for activating the chemiluminescent reactants.

What is finally needed is a method of selecting beverages and chemiluminescent components and, then, assembling the chemiluminescent containers so that the chemiluminescent light can be used to provide information regarding a characteristic of the beverage.

SUMMARY OF THE INVENTION

According to one aspect of the present invention, there is provided a method of enabling the contents of packaged products to be distinguished from each other according to a particular characteristic thereof without opening the packaged product, comprising: including, in each of the packaged products, two mixable substances which are normally separated from each other but which, when the packaged product is subjected to a particular type of manipulation, are brought into contact with each other to product a distinctive optical effect observable without opening the packaged product; the mixable substances in some packaged products being different from those in other packaged products according to the particular characteristic of the contents oC the respective packaged products, such that the particular characteristic of the contents of each packaged product may be indicated without opening the packaged product by merely subjecting the respective packaged product to the particular type of manipulation, and observing the optical effect produced when the two mixable substances therein are brought into contact with each other.

In the described preferred embodiment, the packaged product is a chemiluminscent vessel for bottled beverages, wherein the chemiluminscent vessel comprises: a double walled container having a first sealed cavity containing a first chemiluminescent fluid and having a second sealed cavity containing a second chemiluminescent fluid; a frangible barrier separating the first cavity from the second cavity; and a rotatable member adapted to rupture the frangible barrier during rotation of the rotatable member.

According to another aspect of the present invention, therefore, there is provided a chemiluminscent vessel comprising: a double walled container having a first sealed cavity containing a first chemiluminescent fluid and having a second sealed cavity containing a second chemiluminescent fluid; a frangible barrier separating the first cavity from the second cavity; and a rotatable member adapted to rupture the frangible batiier during rotation of the rotatable member.

A removable protective cap assembly is formed from an inner cap contained within and rigidly attached to an outer cap. The inner cap forms a sealed closure with the neck of the inner container. The outer cap extends to overlay the second portion of the vessel so as to form a protective barrier which shields the compressible toroidal tube from accidental compression. In a preferred embodiment, removal of the protective cap causes a compression tab to engage and compress the tube sufficiently to rupture the frangible barrier. The first and second chemiluminescent fluids mix within the wall cavity producing a chemiluminescent reaction concurrent with the unsealing of the inner container containing the beverage.

Advantageously, the first and second chemiluminescent fluids are selected to produce, when mixed, a specific color connoting a characteristic of the beverage contained in the inner container.

DESCRIPTION OF THE PREFERRED EMBODIMENTS

Figure 1:
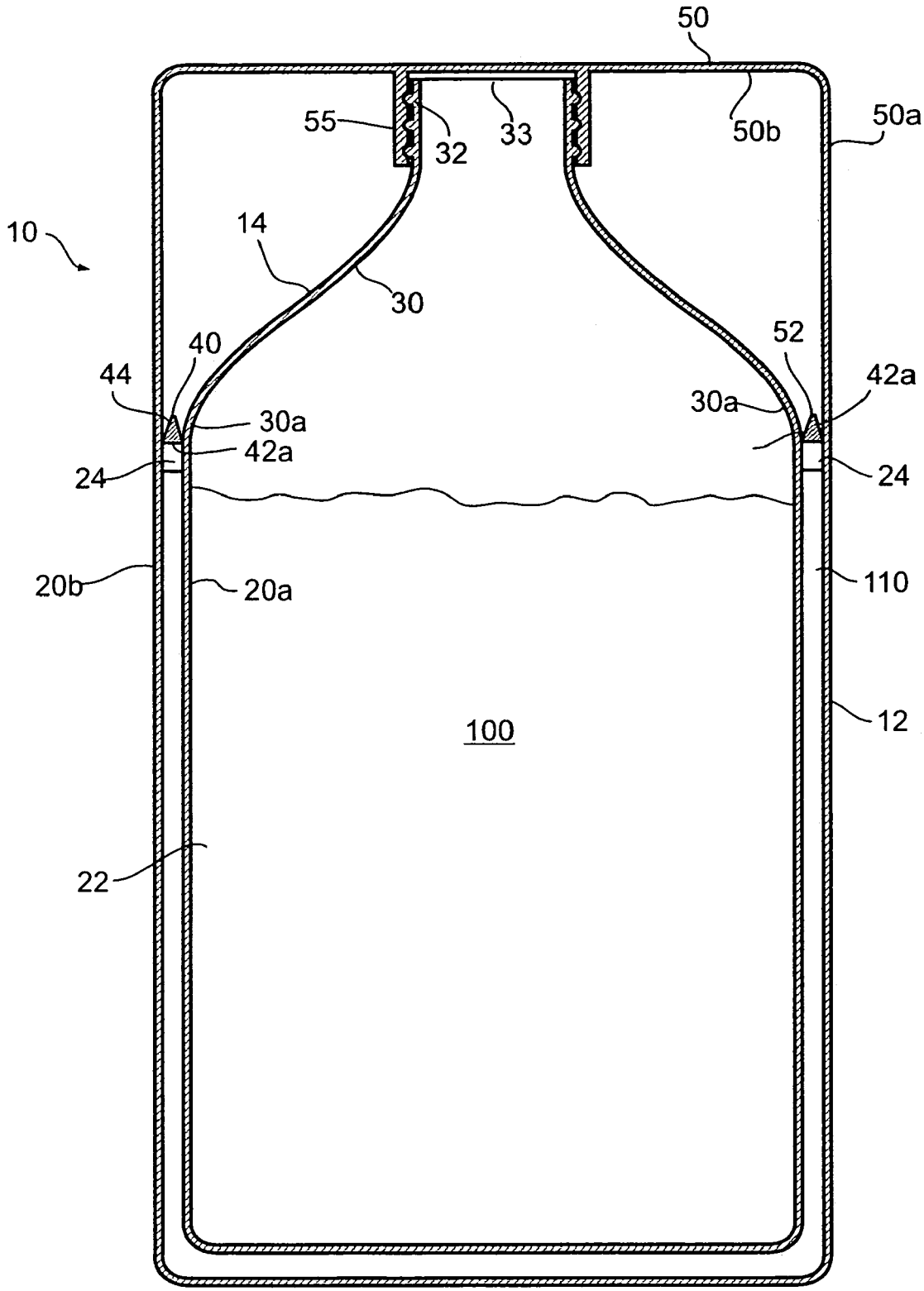
FIGS. 1, 1A and 1B are cross-sectional views of one embodiment of the chemiluminescent vessel of the present invention, with FIG. 1A being an enlarged partial view of the embodiment of FIG. 1 and FIG. 1B being the embodiment of FIG. 1 showing the cap assembly removed.

Referring now to FIG. 1, a chemiluminescent vessel 10 is shown. The vessel 10 comprises a first or lower portion constructed to form a double walled container 12 having an inner perimeter defined by inner sidewall 20*a* and an outer perimeter defined by outer sidewall 20*b*. Container 12 is shaped and adapted such that the portion of the container topographically within the inner sidewall 20*a* defines an inner fluid cavity or reservoir 22, adapted to contain a fluid 100, such as a beverage. A sealed walled cavity 24 is disposed within the double walled container 12 between inner sidewall 20*a* and outer sidewall 20*b* and contains a first chemiluminescent fluid 110.

Referring now to FIGS. 1, 1A, 1B and 3, vessel 10 comprises a second or upper portion 14 having a sidewall 30 contiguous with inner sidewall 20*a* of first portion 12. Sidewall 30 forms a shoulder 30*a* where it meets inner sidewall 20*a*. The sidewall 30 terminates in a neck 32, which defines a fluid opening 33. The neck 32 has exterior lands 34 adapted to receive a closure device, such as by threaded engagement. The sidewall 30 and inner sidewall 20*a* are preferably composed of a translucent material that is a yieldingly deformable material as well. Suitable materials include extruded plastics adapted for drinking containers. Other suitable materials include glass, hard plastics and metals suitable for beverage containers. Still other suitable materials would be obvious to one skilled in the art. Where the vessel 10 is intended to contain fluids 100 other than beverages, other suitable materials adapted to contain the intended fluid would be obvious to one skilled in the art.

Figure 1A:
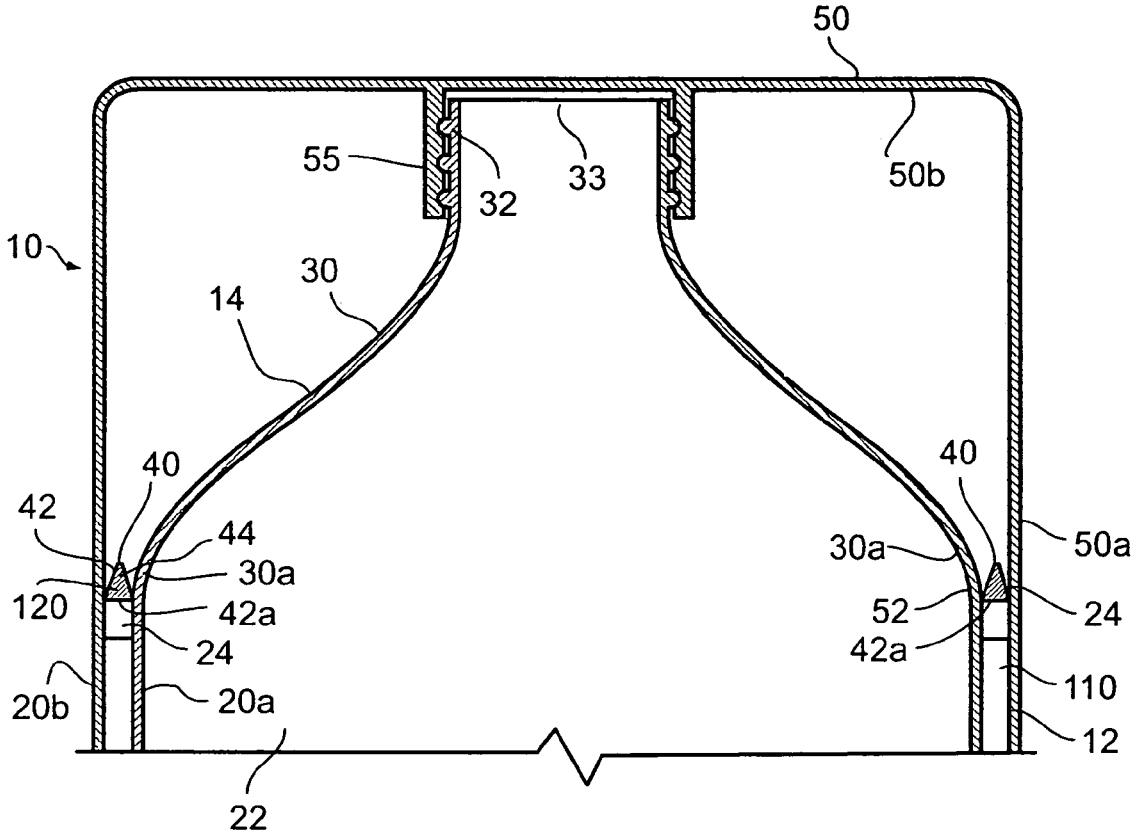
Figure 1B:
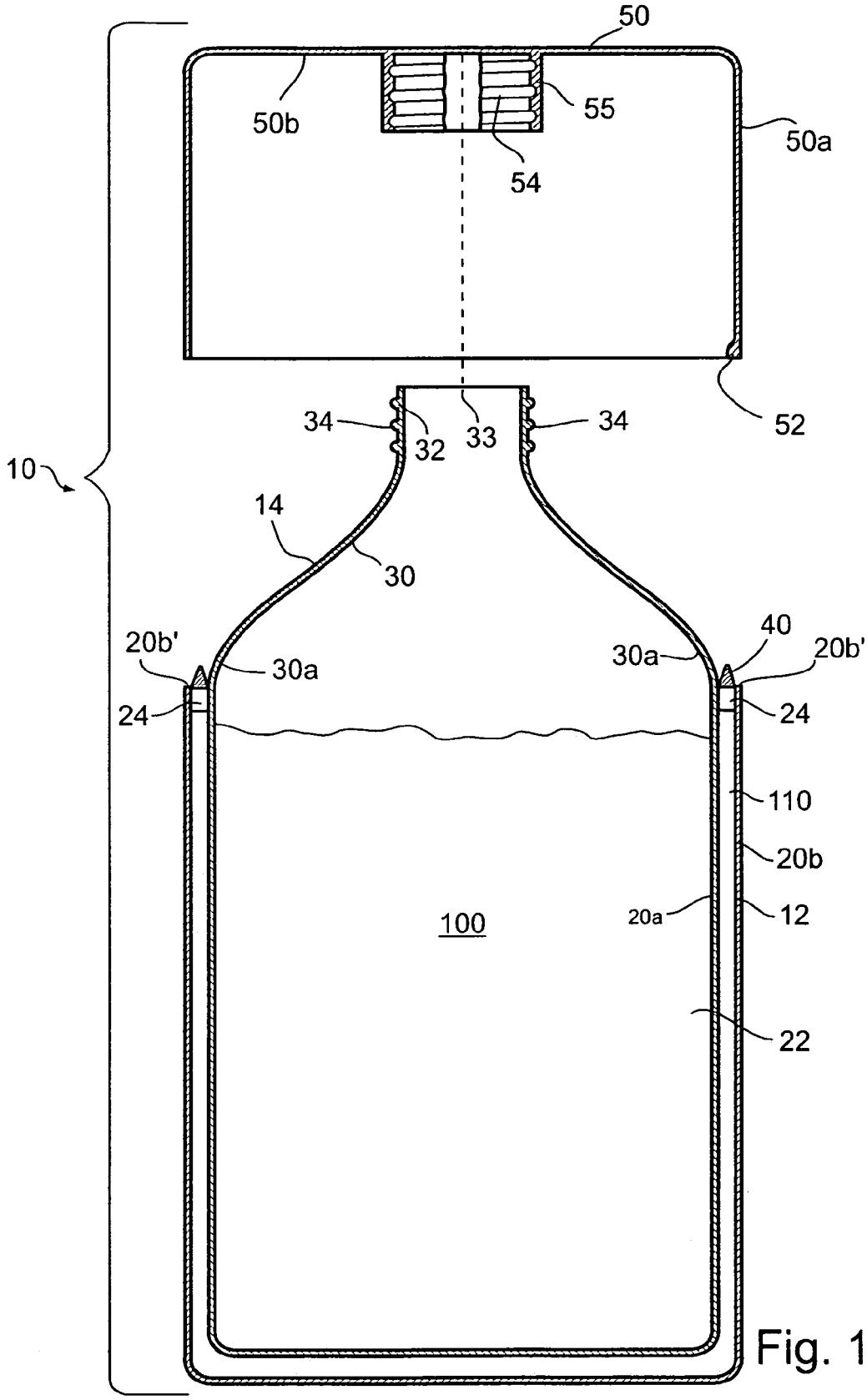

A compressible tube 40 is disposed at or adjacent to the base of wall 30, where it meets inner sidewall 20*a* at shoulder 30*a*. The compressible tube 40 is formed with a tube wall 42 which is frangible along at least a portion 42*a* of its circumference; more particularly, frangible portion 42*a* of tube wall 40 is that portion which will permit fluid communication between the interior of compressible tube 42 and sealed wall cavity 24. The interior of the compressible tube 40 defines a sealed tube cavity 44, which contains a second chemiluminescent fluid 120. The frangible barrier 42*a* separates the tube cavity 44 from the wall cavity 24. A removable, protective cap assembly 50 is shown in FIGS. 1 and 1A received on the second portion 14 of the vessel 10. The protective cap assembly 50 includes a sidewall 50*a* which forms a protective barrier which shields the compressible tube 40 from accidental or premature compression.

Figure 2:
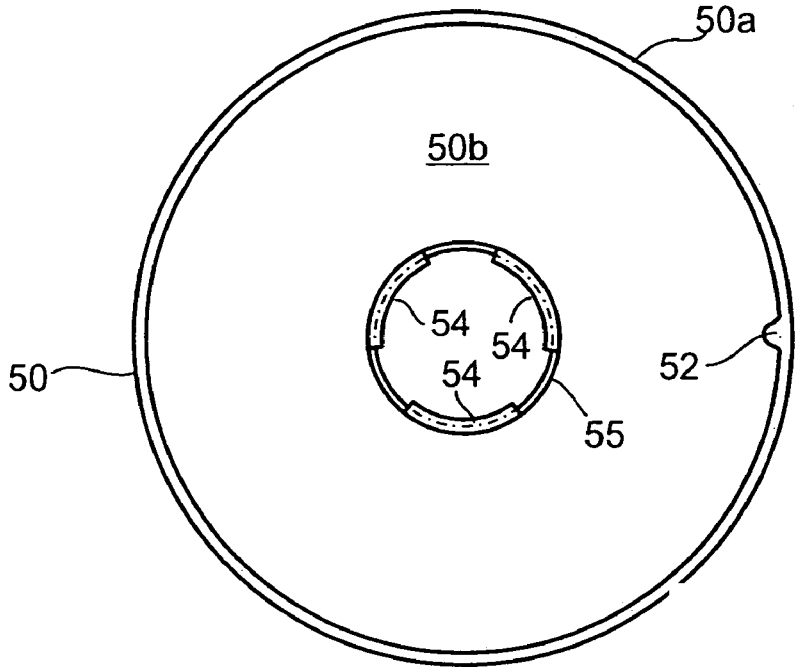
FIG. 2 is an under-side view of the cap assembly of the embodiment shown in FIG. 1.

As shown in FIG. 2, the protective cap assembly 50 includes a structure adapted to compress the tube 40 during removal of the protective cap assembly 50 from the vessel 10. In this embodiment the compression structure is a compression tab 52, although other structures serving the same function could be substituted for the compression tab 52. Rotational removal of the protective cap assembly 50 causes the compression tab 52 to engage and compress the tube 40 sufficiently to rupture the frangible barrier 42*a*. Upon rupture of the frangible barrier 42*a*, the first chemiluminescent fluid 110 and the second chemiluminescent fluid 120 mix within the wall cavity 24.

In the embodiment shown in FIG. 1, the protective cap assembly 50 is adapted to form a rotatably separable closure with vessel 10 so as to contain the fluid 100 within the vessel 10. The invention contemplates use of a removable closure, such as a lid, sealably spanning the inner perimeter 20*a* of vessel 10.

The mixing of the first and second chemiluminescent fluids 110, 120 following rupture of the frangible barrier 42*a* results in a chemiluminescence reaction. The chemiluminescence reaction occurs within the wall cavity 24 and produces light without producing significant heat. Thus, the chemiluminescent vessel 10 may be safely handled during the chemiluminescence reaction without the need for protecting a user from heat. The color of the light produced by the reaction is dependent upon the specific chemicals used to make the components of the reaction, i.e. the specific first and second chemiluminescent fluids 110, 120 employed. Any of a number of colors of light can be selectively produced in a chemiluminescence reaction by selecting the corresponding reactant chemicals as the first and second chemiluminescent fluids 110, 120. Chemiluminescent fluids which can be used in connection with the present invention are well known. Preferably, the first chemiluminescent fluid is an oxalent such as, for example, the oxalent ester present as a solution in the selected propolyene glycol vihydrocardyl ethyl solvent. The oxalent may include the solvent and the fluorescent or just the solvent. The second chemiluminescent fluid comprises the activator capable of providing the desired chemiluminescent effect when combined with the oxalent in a manner well known in the prior art and may include any of a number of well-known, readily, commercially available activators.

The outer sidewall 58 of double walled container 15 is constructed of a translucent material to permit the luminescence to be perceived. Suitable translucent materials would include translucent glass and translucent plastics. More preferably, the outer sidewall 58 and inner sidewall 57 are each formed from a yieldingly deformable material, such as extruded plastics commonly used with beverage containers.

FIG. 1 shows a compressible, interrupted toroidal tube 40 monolithically formed with the frangible barrier 42*a*. As noted, the interior of the interrupted tube 40 forms a sealed toroidal tube cavity 44 which contains a second chemiluminescent fluid 120. The frangible barrier 42*a* separates the wall cavity 24 and the toroidal tube cavity 44. The interrupted toroidal tube 40 is recessed from the top of outer sidewall 20*b* and extends along a circumferential portion of the inner sidewall 20*a*.

A removable protective cap assembly 50 is shown having an outer cap wall 50*a* and an outer cap top 50*b*. The outer cap wall 50*a* is received over the second portion 14 of vessel 10 and is adapted to form a protective barrier over the toroidal tube 40. The protective cap assembly 50 further includes a compression tab 52 adapted to compress the interrupted toroidal tube 40 upon the removal of the protective cap assembly 50. This compression is sufficient to cause the frangible barrier 42*a* to rupture and to allow the first and second chemiluminescent fluids 110, 120 to mix and produce a chemiluminescent reaction. In the embodiment shown in FIG. 1, an upper end 20*b*' of outer sidewall 20*b* is adapted to receive the protective cap assembly 50 so as to form a sealable closure at the outer sidewall 20*b*. In this embodiment the protective cap assembly 50 is rotatably removable from vessel 10 so as to form a rotatably separable closure. One type of closure means employed by an alternative embodiment of the invention comprises exterior lands attached to the upper end 20*b*' and further comprises interior lands of the outer cap wall received by such exterior lands. It would be obvious to one skilled in the art to employ another known method to form closures.

Figure 4A:
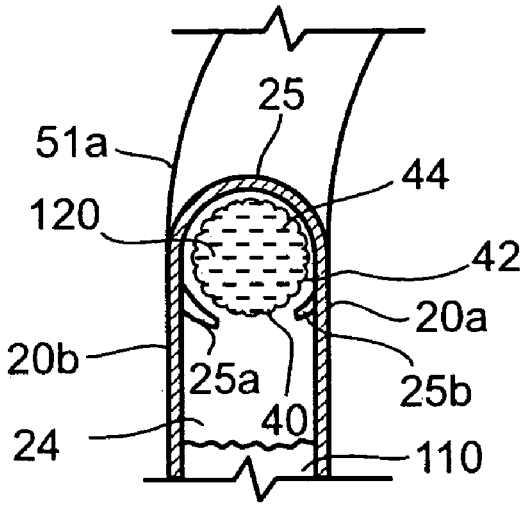
FIGS. 4A, 4B, and 4C are cross-sectional views of three embodiments of the chemiluminescent vessel of the present invention, each view showing details of the toroidal tube and common upper rim of one embodiment.

In another embodiment of the invention, illustrated in FIG. 4A, a toroidal tube 40 of this embodiment is disposed beneath a common upper rim 25 of inner sidewall 20*a* and outer sidewall 20*b*, and maintained in place by ledges 25*a* and 25*b* and within sealed wall cavity 24. In this embodiment, common upper rim 25 is formed from a flexible plastic material such that the common upper rim 25 is readily deformable. The toroidal tube 40 is formed with a frangible wall barrier 42, but is separate from the common upper rim 25. The frangible barrier 42 separates the wall cavity 24 and the toroidal tube cavity 44. The frangible barrier 42 is disposed directly below the flexible common upper rim 25 such that sufficient deformation of the flexible common upper rim 25 will cause the frangible barrier 42 to rupture. In this embodiment, the outer wall 20*b* of vessel 10 can be formed from a hard plastic. The termination of the outer wall 20*b* provides a cap 50 receiving area 21. In this embodiment, the frangible barrier 42 and the flexible common upper rim 25 extend upwardly beyond the termination of the outer wall 20*b* and the cap receiving area 21. In variations of this embodiment, cap receiving area 21 can receive an outer cap wall 51*a*, which forms a protective barrier.

Figure 4B:
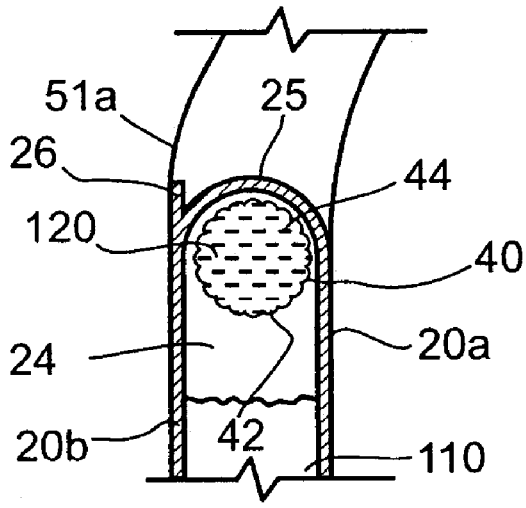

Referring now to FIG. 4B, an embodiment incorporating the features of the embodiment of FIG. 4A is shown. In this embodiment a protective outer collar 26 is disposed upon the outer wall 20*b* at the termination with the common upper rim 25. The protective outer collar 26 is made of a hard material such as hardened plastic and forms a portion of the protective barrier. In one variation of this embodiment the height of the protective outer collar 26 is such that the protective outer collar 26 extends upwardly beyond the frangible barrier 42 and the flexible common upper rim 25 such that the protective outer collar 26 provides a complete lateral shield. In another variation of this embodiment the height of the protective outer collar 26 is such that the protective collar 26 extends upwardly but not beyond the frangible barrier 42 and the flexible common upper rim 25 such that the protective outer collar 26 provides a partial lateral shield. In other variations of this embodiment, the protective outer collar 26 provides a cap receiving area for receiving an outer cap wall 51*a*, which forms another portion of the protective barrier. In yet other variations of this embodiment, a portion of the outer cap wall 51*a* extend downwards beyond the top of the protective outer collar 26.

Figure 4C:
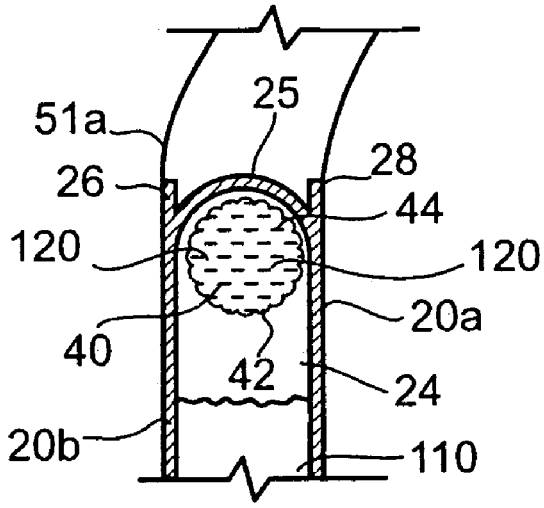

Referring now to FIG. 4C, an embodiment incorporating the features of the embodiment of FIG. 4B is shown. In this embodiment a protective inner collar 28 is disposed upon the inner wall 20*a* at the termination with the common upper rim 25. The protective inner collar 28 is made of a hard material such as hardened plastic. In one variation of this embodiment the height of the protective inner collar 28 is such that the protective inner collar 28 extends upwardly beyond the frangible barrier 42 and the flexible common upper rim 25 such that the protective inner collar 28, together with the protective outer collar 26, provides a channel containing and shielding the frangible barrier 42 and the flexible common upper rim 25. In another variation of this embodiment the height of the protective inner collar 28 is such that the protective inner collar 28 extends upwardly but not beyond the frangible barrier 42 and the flexible common upper rim 25.

Figure 3:
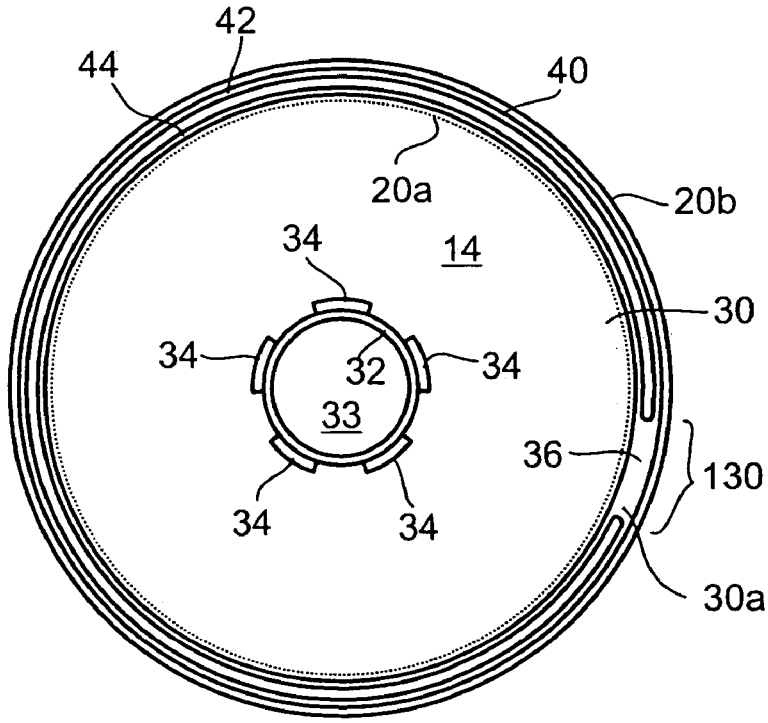
FIG. 3 is a over-head view of the inner and outer containers of the embodiment shown in FIG. 1.

Referring now to FIG. 3, an overhead view of the chemiluminescent vessel 10 is shown. A compressible toroidal tube 40 defines a sealed second component cavity 44. The interrupted toroidal tube 40 extends radially outward along the inner sidewall 20*a* along the shoulder 30*a*. The interrupted toroidal tube 40 extends along an arc around the perimeter of the sidewall 20*a*. The arc spans less than 360 degrees, thus showing an interruption in the toroidal shape of the tube 40. A remnant arc 130 is shown and is defined as equaling the arc of a circle less the span of the arc of tube 40.

FIG. 3 further shows a tab receiving area 36 extending radially outward over the shoulder 30*a*. The tab receiving area 36 extends along the remnant arc 130 around the perimeter of the inner sidewall 20*a*. The second or upper portion 14 of the vessel 10 is shown in FIG. 3. The sidewall 30 is shown terminating in a neck 32 defining a fluid opening 33. The neck 32 is shown having exterior lands 34.

Referring now to FIG. 2, an underside view of the cap assembly 50 is shown. The cap assembly 50 includes an inner cap 55. The inner cap 55 extends downward from the inner cap top 50*b*. Interior lands 54 are shown attached to the inner cap 55 for mating with the exterior lands 34 of the neck 32 of vessel 10 so as to form a threaded rotatably separable closure.

Referring now to FIGS. 1, 1A, 1B and 2, a compression tab 52 is shown attached to the outer cap wall 50*a* into the tab receiving area 36. The cross-sectional view of FIGS. 1 and 1A shows that the compression tab 52 is disposed such that the interrupted toroidal tube 40 will mechanically interfere with movement of the compression tab 52 as the cap assembly 50 is twisted so as to open vessel 10 containing fluid 100. The removal of the protective cap assembly 50 from the chemiluminescent vessel 10 of the embodiment of the invention of FIG. 1 has three simultaneously and interlocked functions: it opens the vessel 10 providing access to the fluid 100 in the inner cavity 22; it removes the protective barrier shielding the interrupted toroidal tube 40 from premature or unintentional compression; and it causes the compression tab 52 to compress the interrupted toroidal tube 40 sufficiently to rupture the frangible barrier 42*a* and produce a chemiluminescent reaction.

One novel aspect of this invention is the method of assembly of the embodiments shown in FIG. 1. Referring again to FIGS. 2 and 3, it can be seen that the embodiment of this invention shown as assembled in FIG. 1 must have proper alignment of the compression tab 52 of the cap assembly 50 to prevent compression of the interrupted toroidal tube 40 during assembly. Since the vessel 10 is rotatably opened, one method of assembly would suggest twisting the cap assembly 50, and thus the inner cap 55, onto the neck 32. However, this would cause the compression tab 52 of the cap assembly 50 to rotate through and compress the interrupted toroidal tube 40 during this method of assembly.

This difficulty has been overcome by employing an additional embodiment of the current invention. In this embodiment, assembly is accomplished by first filling the inner cavity 22 with a selected fluid 100. The cap assembly 50 is the positioned above and aligned such that the compression tab 52 is positioned above the tab receiving area 36 without extending over any portion of the interrupted toroidal tube 40. With the components properly aligned, pressure is applied to the cap assembly 50 sufficient to force the inner cap 55 to slide over the neck 32. Since the inner cap 55 and the neck 32 are composed of a yieldingly deformable material, the components elastically deform to allow the inner cap 55 to slide over the neck 32.

The chemiluminescent vessel 10 of the embodiment of FIG. 1 has an inner fluid cavity 22 suitable for packaging a beverage fluid 100. Since the removable, protective cap assembly 50 is designed such that opening vessel 10 is necessarily simultaneous with compression of the interrupted toroidal tube 40 and rupture of the frangible barrier 42*a*, the beverage 100 must be placed in the inner cavity 22 during assembly of the chemiluminescent vessel 10. Thus, a user can safely assume that the presence of a light from chemiluminescent reaction upon opening the chemiluminescent vessel 10 signals the corresponding presence of the originally packaged beverage (or other goods, such as a medicine) 100 within the chemiluminescent vessel 10. This novel feature of the apparatus of this invention provides for a novel method of practicing the invention in the field of beverage delivery.

The selection of the beverage 100 packaged in the chemiluminescent vessel 10 can be coordinated with the selection of the color of the chemiluminescence reaction through the selection of the chemical components comprising the first and second chemiluminescent fluids 110, 120. Thus the characteristic of color can be used to provide information regarding a characteristic of the packaged beverage 100.

One example of using this novel method is coordinating the proof of an alcoholic beverage packaged within a particular chemiluminescent vessel 10 with the color of the chemiluminescent light produced by opening the chemiluminescent vessel 10. In this exemplar method, the first and second chemiluminescent fluids 110, 120 can be selected from a number of component chemiluminescent fluids to produce any of three chemiluminescent colors: green, blue and red. Similarly and by example, the alcohol content of the packaged beverage can be selected from 10 proof, 40 proof, and 100 proof. By matching each selectable color to a different selectable alcohol level, the color gives the consumer a visual signal of the alcohol content of a newly opened chemiluminescent vessel 10. For example, green can be paired with 10 proof, blue can be paired with 40 proof, and red can be paired with 100 proof. Following this method, if an individual consumer who has been provided an unopened chemiluminescent vessel 10 containing a beverage subsequently twists off the cap assembly 50 and observes a blue chemiluminescent light, that consumer knows that the beverage 100 contained within the vessel 10 has a 40 proof alcohol content.

Thus, in practicing this novel method, the methods of assembling the chemiluminescent vessel 10 further include the steps of selecting and providing the beverage 100 to be packaged in the chemiluminescent vessel 10 from a predetermined group of beverages. Next, a color is selected from a predetermined group of colors, each color of the group of colors corresponding to a separate beverage of the predetermined group of beverages. Then, selecting the first and second chemiluminescent fluids 110, 120 from a predetermined group of chemiluminescent fluids, wherein the selected first and second chemiluminescent fluids 110, 120 are adapted to reactively produce the selected color corresponding the selected beverage 100. The appropriate components of a chemiluminescent vessel 10 containing the selected first and second chemiluminescent fluids 110, 120 are then provided. The assembly of chemiluminescent vessel 10 so as to sealably package the selected beverage 100 proceeds as described above.

Other embodiments of this invention and methods of practicing the same are directed at other combinations of colors and beverages, such as soft drinks and sports drinks. Still other embodiments are directed at packaging consumer goods other than beverages, such as medicines, perfume, shampoo and mouthwash. One skilled in the art will recognize that this invention and method of practicing the same may be modified for packaging fluids for use in various reduced visibility conditions.

Thus, although there have been described particular embodiments of the present invention of a new and useful Chemiluminescent Vessel, it is not intended that such references be construed as limitations upon the scope of this invention except as set forth in the following claims:

What is claimed is:

1. A method of enabling the content of packaged products to be distinguished from each other according to a particular characteristic thereof without opening the packaged product, comprising:

including, in each of the packaged products, two mixable substances which are normally separated from each other but which, when the packaged product is subjected to a particular type of manipulation, are brought into contact with each other to product a distinctive optical effect observable without opening the packaged product;

the mixable substances in some packaged products being different from those in other packaged products according to the particular characteristic of the contents of the respective packaged products, such that the particular characteristic of the contents of each packaged product may be indicated without opening the packaged product by merely subjecting the respective packaged product to said particular type of manipulation, and observing the optical effect produced when the two mixable substances therein are brought into contact with each other.

2. The method according to claim 1, wherein said packaged products are bottled beverages.

3. The method according to claim 2, wherein said particular characteristic is or includes the alcoholic content of the respective beverage.

4. The method according to claim 2, wherein said particular characteristic is or includes the flavor of the respective beverage.

5. The method according to claim 3, wherein said particular characteristic is or includes the color of the respective beverage.

6. The method according to claim 1, wherein said packaged products are chemiluminscent vessels, and said two mixable substances are chemiluminscent substances which, when brought into contact with each other, produce a distintinctive chemilurninscent effect visually observable without opening the respective chemiluminscent vessel.

7. The method of claim 6, wherein said chemihiminescent vessel comprises:

a double walled container having a first sealed cavity containing a first chemiluminescent fluid and having a second sealed cavity containing a second chemiluminescent fluid;

a frangible barrier separating said first cavity from said second cavity;

and a rotatable member adapted to rupture said frangible barrier during rotation of said rotatable member.

8. The method of claim 7, wherein said rotatable member comprises a cap assembly received by said double walled container and adapted to enclose said frangib1e barrier and thereby prevent rupture of said frangible barrier prior to rotation of said cap.

9. The method of claim 8, wherein said cap assembly is removable and comprises a projection adapted to rupture said frangible barrier during removal of said cap assembly.

10. The method according to claim 1, wherein said chemiluminscent vessels are bottles closed by caps, and said particular manipulative step is, or includes, removing the cap of the respective bottle.

11. A chemiluminscent vessel comprising:

a double walled container having a first sealed cavity containing a first chemiluminescent fluid and having a second sealed cavity containing a second chemiluminescent fluid;

a frangible barrier separating said first cavity from said second cavity; and a rotatable member adapted to rupture said frangible barrier during rotation of said rotatable member.

12. The chemiluminscent vessel according to claim 11, wherein said rotatable member comprises a cap assembly received by said double walled container and adapted to enclose said frangible baffler and therefore prevent rupture of said frangible barrier prior to rotation of said cap.

13. The chemiluminscent vessel according to claim 12, wherein said cap assembly is removable and adapted to rupture said frangible barrier during removal of said cap assembly.

* * * * *